United States Patent [19]

Schuettenberg et al.

[11] Patent Number: 4,515,740

[45] Date of Patent: May 7, 1985

[54] METHOD OF FORMING SOLID FORM FUEL ADDITIVES

[75] Inventors: Alexander D. Schuettenberg; James T. Gragson, both of Bartlesville, Okla.

[73] Assignee: Phillips Petroleum Company, Bartlesville, Okla.

[21] Appl. No.: 403,981

[22] Filed: Aug. 2, 1982

Related U.S. Application Data

[60] Division of Ser. No. 197,457, Oct. 16, 1980, , Continuation-in-part of Ser. No. 112,363, Jan. 15, 1980, abandoned.

[51] Int. Cl.[3] ..... B29D 27/00

[52] U.S. Cl. ..... 264/50; 44/56; 44/66; 44/71; 264/117; 264/120; 264/141

[58] Field of Search ..... 264/50, 141, 117, 120; 44/71, 66, 56

[56] References Cited

U.S. PATENT DOCUMENTS

| | | | |
|---|---|---|---|
| 2,583,938 | 1/1952 | French | 264/50 |
| 3,505,244 | 4/1970 | Cessna | 252/316 |
| 3,733,184 | 5/1973 | Zimmerman | 585/9 |
| 3,849,323 | 11/1974 | Hollinshead | 44/66 X |
| 3,981,682 | 9/1976 | Ward et al. | 44/71 X |

*Primary Examiner*—Philip Anderson
*Attorney, Agent, or Firm*—French & Doescher

[57] ABSTRACT

Engine deposits are controlled by dispensing an additive to fuel. In one aspect, the additive comprises paraffins. In another aspect, a solid form additive for dispensing fuel additive to fuel in solid form is provided by employing a structural agent which is soluble and dispersible in fuel to contain and provide dimensional stability to the additive.

23 Claims, No Drawings

METHOD OF FORMING SOLID FORM FUEL ADDITIVES

This application is a divisional of Ser. No. 197,457, filed Oct. 16, 1980, which is a continuation-in-part of Ser. No. 112,363, filed Jan 15, 1980, now abandoned.

The invention relates to additives for fuel. In one of its aspects, the invention relates to detergent additives for fuel. In another of its aspects, the invention relates to solid form additives for fuel.

Fuels can be compounded with a variety of additives. Alternatively, the additive can be added to the fuel after the fuel is made. Such additives can include, for example, detergent additives to maintain a clean carburetor, valve and/or carburetor deposit control additives for reducing and/or preventing engine deposits, rust inhibitors, antiknock additives, emulsifiers or demulsifiers, fuel biocides, dyes, fuel pour point depressants and cetane improvers for diesel fuels, and the like. The additives can, for example, be added to the fuel after the fuel is dispensed into the fuel tank of an internal combustion engine. Typically, such additives are dispensed in liquid form.

With the advent of pollution standards for automobile exhausts, it has become important that fuel additives not contain metal ions that tend to poison the catalyst in automotive engine exhaust converter systems. An additive mixture which does not contain metal ions and which performs well in a variety of detergency and gum deposit tests based on readily available vegetable oils is therefore desirable.

The need for various additives to insure that various engines such as internal combustion engines operate properly and the increased demands for carburetor cleanliness, for example, as a result of antipollution devices, have made highly desirable solid form additives which can be easily dispensed to the fuel tank by the individual user in solid form in amounts suitable for use.

Accordingly, an object of the invention is solid form additives for fuel which can be added to fuel tanks. Another object of the invention is pelletized additives for addition to fuel in fuel tanks. Another object is encapsulated additives for addition to fuel in fuel tanks. Another object is solid form additives for addition to fuel in fuel tanks wherein the additives rapidly dissolve and readily disperse in the fuel. Another object is low density solid form additives for addition to fuel in fuel tanks wherein the additives float, dissolve, and readily disperse in the fuel. Another object is to provide solid form additives in predetermined amounts. Another object is method of making such solid form additives. Another object is solid form carburetor detergent additives for addition to fuel in fuel tanks. Other objects and advantages of this invention will be obvious to one of ordinary skill in the art from the following description and the claims.

SUMMARY OF THE INVENTION

In accordance with the invention there is provided a deposit control additive for controlling deposits in engines, in a specific embodiment, in internal combustion engines, although not limited thereto. The deposit control additive comprises paraffin wax added to fuel for the engine in an amount effective to control deposits, in a preferred embodiment, valve deposits, the paraffin wax having a melting point such that it is solid at ambient temperatures and is soluble in the fuel in the amounts effective to reduce deposits.

Further, in accordance with the invention there is provided a solid form additive, comprising a fuel additive suitable for use in fuel and a structural agent for containing and providing dimensional stability to the fuel additive, the structural agent being soluble and dispersible in the fuel. In accordance with another aspect of the invention, the solid form additive has a density less than the density of the fuel. In accordance with further aspects of the invention methods are provided for making such solid form additives. In yet a further aspect the invention comprises a method of dispensing a fuel addtive to fuel comprising introducing a solid form addtive in accordance with the instant invention into a tank containing fuel, and dissolving and dispersing the solid form additive therein.

DETAILED DESCRIPTION OF THE INVENTION

As used herein, deposit control additive means any additive compatible with fuel and effective for reducing already existing deposits present in the engine and/or effect for a least decreasing the rate at which such deposits are laid down.

The desposit control additive comprising paraffin wax in accordance with the invention can be any paraffin wax added to fuel in an amount effective to control deposits and having a melting point such that the wax is solid at ambient temperatures of about 70° F. (23° C.) and is soluble in the fuel in said amount effective to control deposits. Generally, the upper limits for solubility in fuel will involve those paraffins having melting points in the range of about 180° F. to about 200° F. (about 82° C. to about 94° C.) and paraffins having melting points above this range are presently not preferred because of solubility aspects, although it is expected that if adequately solubilized, the paraffins would act as deposit control additives. The paraffins presently contemplated comprise in the range from about 18 to 32 carbon atoms per molecule, are predominantly straight chain alkanes (although some branching may be present) having a molecular weight in the range of about 250 to about 450, and will generally have a melting point in the range of about 70° F. (23° C.) to about 180°-200° F. (82°-94° C.). The paraffin wax will be added to the fuel in an amount generally in the range of about 20 ptb (pounds per thousand barrels) to about 300 ptb.

Preferably the paraffins will have melting points in the range of about 150° F. (46° C.) to about 160° F. (71° C.) because paraffins in this range are suitable encapsulating agents for solid form additives in accordance with the invention described in more detail below. Most preferably, the paraffins will have melting points in the range of about 130° F. (54° C.) to about 160° F. (71° C.) because paraffins in this range are particularly effective in acting as encapsulating or solidifying agents for solid form additives as described below.

As used herein, solid form additives include any suitable means for dispensing usually liquid fuel additives in solid form. Solid form additives are used herein to describe additives which have at least an essentially solid exterior portion, but which can in certain embodiments, though not necessarily, have a liquid interior. Such additives can include fuel additives put into solid form by methods such as encapsulation, including microencapsulation, pelletizing, tabletizing, and the like. Such solid form additives can be essentially homogeneous as, for example, in pelletizing wherein the fuel additive is essentially homogeneously interspersed with the structural agent, or can be heterogeneous as in encapsulation having an essentially solid exterior portion and an essentially liquid interior portion. Thus solid form additives are used generically to broadly include additives prepared by encapsulation, microencapsulation, pelletizing, tabletizing, and the like. As further used herein, a structural agent is a compound or composition which is utilized to contain and to provide rigidity or to give structural or dimensional stability or support to a ususally liquid fuel additive to permit dispersing the normally liquid additive in solid form. As thus used, structural agents comprise, for example, solidifying agents, encapsulating agents, pelletizing agent, and the like which can be used in the preparation of solid form additives.

As used herein, a solidifying agent or pelletizing agent is a meltable solid which can be combined with a liquid to form a solid product which does not flow at ambient temperature. Solidifying a liquid is the method of combining the liquid with the meltable solid to form the solid product. A pellet or tablet is the shaped, molded, or extruded form of the solid product.

An encapsulating agent is a meltable or dissolvable solid which can be used to entrap or contain a liquid which remains liquid after encapsulation. Encapsulating is the method of entrapping or containing the liquid which remains liquid when enclosed by the meltable or dissolvable solid. A capsule is the shaped or molded form of the encapsulated product.

The fuel additive in accordance with this invention can be any suitable additive for use in fuel, for example, in gasoline or in diesel fuel. Although in the illustrated embodiments the fuel additives are such as are normally liquid at ambient temperature, the invention is not to be considered limited thereto but is applicable also to solid additives which it is desired to place into convenient and safe format for handling, storing, despersing and the like. Such normally liquid additives are liquid in at least a portion of an ambient temperature range between about −20° F. and about 110° F. The normally liquid fuel additive can be, for example, a carburetor detergent additive to reduce carburetor deposits; rust inhibitors; antiknock additives such as tetraethyl lead, methylcyclopentadienylmanganese tricarbonyl (MMT), phenolic antiknock compounds, and the like; emulsifiers and demulsifiers to meet the need to exclude or include water; fuel biocides; dyes; fuel pour point depressannts or cetane improvers for diesel fuels; and other suitable fuel additives.

In a preferred embodiment, the fuel additive can comprise a detergent additive for fuels. The detergent additive can be, for example, a detergent composition prepared by reacting a sulfonic acid with the product mixture obtained from the reaction of a vegetable oil and multiamine.

The vegetable oil can be selected from those commonly available such as cotton seed oil, rapeseed oil, peanut oil, corn oil, coconut oil, soybean oil, and the like. These vegetable oils are mostly long chain triglycerides of long chain monocarboxylic acids containing 10 to 25 carbon atoms per acid moiety. The monocarboxylic acids can be such as, for example, lauric, myristic, stearic, palmitic, palmitoleic, oleic, linoleic, and the like.

The triglycerides can be represented by the formula shown below:

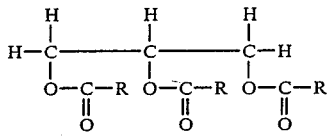

where R is an aliphatic radical of about 10 to 25 carbon atoms.

Generally, the vegetable oils contain glycerides of a number of kinds of acids. The number and kind can vary with the source vegetable of the oil.

Among the multiamines that can be utilized in this detergent additive are those having the general formula $H_2N(CH_2CH_2NH)_xH$, where x is an integer in the range of 2 to 10, preferably 3 to 6. Representative multiamines can include, for example, ethylenediamine (EDA), tetraethylenepentamine (TEPA), pentaethylenehexamine (PEHA), and the like. Mixtures of two or more multiamines can also be used. More complex multiamines can also be used. Representative of the more complex multiamines is polyethylenemimine (PEA), one of the multiamines preferred for use in making this detergent composition.

The relative amounts of vegetable oil and multiamine employed can be expressed in terms of the molar ratio of triglyceride to nitrogen (N). Broadly, this ratio can be in the range of 0.05:1 to 1.00:1 and preferably this ratio is from 0.13:1 to 0.80:1.

The first reaction, which is between vegetable oil and multiamine, results in a product mix which is a mixture of glycerol, partly esterified glycerol such as mono- and diglycerides, and amides and imidazolines of the fatty acid, for example,

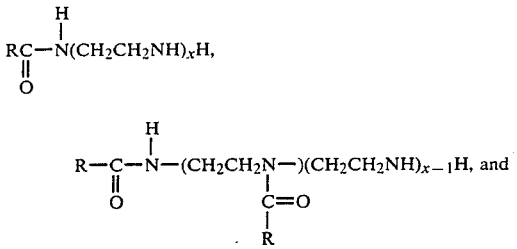

wherein x is defined above. Reaction conditions for the first reaction are: temperature in the range of about 35° C. to about 260° C. preferably about 120° C. (248° F.) to about 200° F. (390° F.), reaction time about 1 hour to about 16 hours, preferably about 4 to 9 hours; reaction pressure can be atmospheric pressure but is generally between about 0 to about 50 psig when no diluent is present. If a diluent is present, the reaction pressure is generally essentially that produced by the vapor pressure of the diluent at the temperature employed. It is also preferable to use an inert atmosphere such as, for example, nitrogen over the reaction mixture. The product mixes from the first reaction were found to be effective detergent additives but could generally not pass the water tolerance test when tested by ASTM D 1094 72.

Treatment of the product mix of the first reaction, however, by a second reaction with a strong acid, for example, sulfonic acid, can produce additives with a good detergency which can also pass the water tolerance test. Suitable sulfonic acids have the general formula $R'SO_3H$ where R' is alkyl, aryl, alkaryl, cycloalkyl with 6 to 100 carbon atoms. Representative sulfonic acids include dodecylbenzene sulfonic acid, octadecylsulfonic acid, dodecylsulfonic acid, and sulfonic acid oil. The sulfonic acid mixture obtained by treating lubricating stock with sulfur trioxide, for example, mahogany acid and the like, can also be effectively employed in the second reaction.

The second reaction, that is, the treatment of the product mix of the first reaction with a strong acid, is a neutralization reaction which can take place at atmospheric pressure. The reaction mixture requires stirring to achieve homogeneity which generally requires stirring from about 1 to about 300 minutes, more generally about 60 and about 120 minutes. The reaction mixture can be treated with heat applied mostly for the purpose of reducing viscosity. The temperature can be in the range of about 25° C. (77° F.) to about 100° C. (212° F.), more preferably in the range of about 40° C. (104° F.) to about 70° C. (158° F.).

The strong acid such as, for example, sulfonic acid, mostly reacts preferentially with the amino groups remaining in the multiamines after the first reaction.

The first reaction and the second reaction can preferably be carried out in the absence of diuent to produce an undiluted detergent additive. Alternatively, normally liquid hydrocarbon diluents, such as aromatic hydrocarbons having from 6 to 10 carbon atoms per molecule, can be utilized in either the first reaction or the second reaction. However, if such diluents are used in the preparation of the detergent addtive, it is then necessary to strip the diluent from the additive mixture to produce an undiluted detergent additive. It is preferable to employ an undiluted detergent additive to form the solid form additive in accordance with the present invention because the presence of hydrocarbon diluent can weaken or dissolve the structural agent utilized in the preparation of such solid form additives.

The final detergent additive product composition is quite complex and the distribution of possible reaction products depends upon the ratio of vegetable oil to multiamine. However, a large excess of strong acid is preferably avoided to achieve a detergent additive product composition with a pH more basic than about pH 6.

Further in accordance with the invention, the solid form additive can comprise polyolefin polymers and their corresponding hydrogenated derivatives in an amount for controlling valve deposits in engines. In combination with a carburetor detergent as described above, such solid form additives can act as total deposit control additives (TDC) to reduce deposits on both carburetors, valves, and intake ports of internal combustion engines. The polyolefins which can be so employed include polymers prepared from monoolefins and diolefins or copolymers of either having an average molecular weight broadly in the range of about 500 to about 3500. Olefins which can be used to prepare such polyolefin polymers include ethylene, propylene, butene, isobutene, amylene, hexylene, butadiene, and isoprene.

Particularly preferred are hydrogenated polybutenes. The hydrogenated polybutenes can have molecular weights in the range of 700 to 1100, more preferably in the range of 800 to 1000, most preferably about 900, for effective reduction of valve deposits. The polybutenes can be added to fuel in an amount in the range of about 20 ptb (pounds per thousand barrels) to about 300 ptb, more preferably in the range of about 40 to 60 ptb, and most preferably about 50 ptb. At least partially hydrogenated polybutenes are particularly preferred.

The composition of the additive can influence the structural stability of the solid form additive. Coversely, the structure of the additive can influence the composition of the additive. For example, when an uncoated solid form additive is employed, it is desirable to utilize a larger relative amount of structural agent whereas when a coated solid form additive is employed, larger relative amounts of additive can be utilized.

Thus, when an uncoated solid form additive is employed, in the case of the detergent additive and/or the polyolefins above described, and for most other suitable liquid fuel additives, each liquid fuel addtive will broadly comprise in the range of 0 to about 40% by weight of the total solid form addtive so long as at least some liquid fuel additive is present. More preferably, each liquid fuel additive will comprise between 10% and about 30% by weight, and most preferably between about 15% and about 25% by weight of the total solid form additive, since uncoated solid form additives with these compositions have good temperature stability and are effective in reducing engine deposits.

Similarly, when a coated solid form additive is employed, in the case of the detergent additive and/or the polyolefins hereinabove described, and for most other suitable liquid fuel additives the liquid fuel additive will broadly comprise in the range of about 0 to about 75% by weight of the total solid form additive so long as at least some liquid fuel additive is present. More preferably, the liquid fuel additive will comprise between 25% and 75% by weight of the total solid form additive, and even preferably in the range from 30% to 50% by weight. However, in its broadest aspects the present invention is not to be limited to the above ranges as the useful concentration of additive by weight can easily be determined by one of ordinary skill in the art and for a given fuel additive the optimum amount may be outside the above ranges.

The fuel can be any dydrocarbon useful as an internal combustion system fuel, especially such hydrocarbon mixtures as are used in commerical fuel blends, for example, gasoline, diesel fuel, and the like.

The structural agent in accordance with this invention can be any suitable structural agent for containing and providing dimensional stability to the fuel additive and which is soluble and dispersible in the fuel. Preferably the solid form additive comprising structural agent and fuel additive has a density less than the density of the fuel so that the solid form additive will float and disperse in the fuel thereby avoiding blocking fuel intake lines and the like. However, solid form additives having a density greater than that of the fuel and capable of rapid dissolution in the fuel are also a preferred embodiment of the invention and are also further described below.

As noted above, the structural agents in accordance with the invention include pelleting or solidifying agents. Any suitable pelleting agent which can dissolve and disperse in fuel can be used. Preferably, the pelletizing agent is one which can be foamed to entrap gas when solidified. Suitable pelleting agents can preferably include, for example, petroleum waxes or wax like materials which can dissolve in fuels and which can be foamed to entrap gas when solidified. Such waxes can include, for example, refined paraffin waxes with melting points in the range of about 110° F. (43° C.) to about 160° F. (71° C.) and with molecular weights in the range of about 340 to about 430 and comprising hydrocarbons containing in the range of 18 to 32 carbon atoms.

Typically, paraffins comprise a mixture of molecular weights and carbon numbers. Hence, reference is usually made to paraffins by specifying a melting point range. The paraffin waxes in accordance with the invention as herein defined comprise primarily straight chain hydrocarbons with relatively small proportions of branched or isoparaffinic material. Broadly paraffins suitable for use as structural agents in accordance with this invention can have melting points at least above 110° F. (43° C.). Preferably, the melting point is between about 115° F. (46° C.) and about 160° F. (71° C.), more preferably between about 130° F. (54° C.) and about 160° F. (71° C.).

Such petroleum waxes can also include slack wax having up to 25% oil content although a slack wax having an oil content in the range of about 2 to about 10% is desired for economy and strength. Scale wax can also be used as a pelleting agent in accordance with the invention.

As is known in the refining art, these waxes are produced during refining processes. In fractionating crude petroleum, the raffinate or cut known as paraffin distillate can be separated into solid wax fraction and liquid oil fraction by chilling and filter pressing. The solid wax fraction is the slack wax which can contain as much as such as 35% by weight of oil. The slack wax can be further refined. One step, known as sweating, reduces the oil content of the slack wax to about 2% and results in a product known as scale wax. A final step in the refining can remove essentially all remaining oil to give the product known as refined paraffin wax.

As indicated, for the structural agents of the instant invention, refined paraffin waxes having melting points at least above 110° F. (43° C.), preferably, broadly in the range of about 115° F. (46° C.) to about 160° F. (71° C.), more preferably in the range of about 130° F. (54° C.) to about 160° F. (71° C.), and having average molecular weights in the range of 340 to 430 and containing hydrocarbons having from 18 to 32 carbon atoms can be used as solidifying agents. Slack wax having up to 25% by weight oil content and scale wax can also be used as solidifying or encapsulating agents.

Long chain alcohols as described below can also be used as structural agents according to the invention.

In addition to the paraffin waxes and long chain alcohols described below suitable waxy polymeric substances can also be employed in the practice of the invention. Any suitable waxy polymeric substance which is soluble and dispersible in fuel can be used. For example, ethylene derived hydrocarbon polymers such as Vybar$^{(R)}$ 260, available from Petrolite Corp., Pareco Div., Tulsa, OK, can also be utilized as a pelletizing agent in accordance with this invention.

Mixtures and combinations of these paraffin waxes and waxy polymeric compounds can also be used in the practice of the invention. For example, a mixture of refined paraffin wax and Vybar 260 can be used where the refined paraffin wax comprises in the range of about 90 to about 99 percent by weight of the total mixture, more preferably from about 95 to about 99 percent by weight.

Modifiers can also be added to the pelletizing agents for particular purposes. For example, long chain alcohols, such as octadecanol and the like can be added to raise the melting point of the tablet or can be used alone in combination with a fuel additive as pelletizing agents. Preferably the long chain alcohols have from 14 to 24 carbon atoms per molecule, more preferably from 16 to 20. Such alcohols are soluble in fuel but nonfoaming alone. However, in the presence of additives such as, for example, detergent additives of the type described herein, adequate foaming is observed and therefore, in combination with an additive, such long chain alcohols can be used as a pelletizing material in accordance with the invention. Broadly the melting point of the pelletizing material is at least 110° F. (43° C.), preferably in the range of about 115° F. (46° C.) to about 160° F. (71° C.), more preferably in the range from 130° F. (54° C.) to 160° F. (71° C.), to facilitate storage and handling at ambient conditions.

Further in accordance with the invention, the structural agent can comprise aromatic compounds having melting points about 130° F.–355° F. (55° C.–180° C.) and which are readily soluble and dispersible in fuel. Exemplary compounds of this class include such compounds as durene, naphthalene, 1,4-dimethoxy benzene, hexaethyl benzene, hexamethyl benzene, pentamethyl benzene, 1,3,5-triphenyl benzene, and the like.

Preferred among these compounds are naphthalene and durene. Most preferred is durene because of its high solubility in fuel and its temperature stability. When durene is used, however, it is contemplated that a foil or other suitable coating to reduce loss by sublimation will be employed because durene can sublime at the temperatures involved.

Broadly the durene can comprise between about 50% and about 95% by weight of a solid form additive in accordance with the invention. Preferably, the durene will comprise between 70% and 90% by weight of the solid form additive, and most preferably between about 75% and about 85% by weight, since compositions in this range have been found to have good temperature stability consonant with good deposit control when used with suitable liquid fuel additives. The amount of durene added to the fuel can range between about zero to about 300 ptb, or even higher, more preferably in the range of about 50 to 100 ptb.

The density of the tablet is preferably less than that of the fuel into which the solid form additive will be introduced so that the pellet will float to facilitate dissolution and avoid blockage of the inlet to fuel lines and the like. However, such a low density tablet is not necessarily preferable when mechanical mixing is available and the invention is not limited to such low density solid form additives. A low density tablet can be obtained by choosing a pelleting agent having a suitably low density that the resulting tablet will float in fuel, by composition, or by artificially decreasing the density of the tableting material, for example, by foaming.

In accordance with one aspect of this invention there is provided a method for pelletizing a fuel additive to form a solid form additive, the method comprising heating together a pelletizing agent and an additive to at least the melting point temperature of the agent; allowing the thus formed mixture to cool; stirring the thus formed mixture; and foaming the mixture by dispersing a gaseous phase as fine bubbles in the mixture, said mixture being close to but above the solidification temperature of the mixture.

The gaseous phase can be any suitable gas effective for foaming the tableting agent. For example, the gaseous phase can comprise nitrogen ($N_2$), air, carbon dioxide ($CO_2$), or mixtures thereof.

In a further aspect of the invention, the thus formed foam can be molded or extruded and allowed to cool, retaining most of its foamed volume. The cooled pellet, tablet, or extrudate can then be sealed with a coating agent. The coating agent can be any suitable material which can seal the surface of the pellet, tablet, or extrudate and which is soluble and dispersible in fuel. For example, the coating agent can be any of the materials indicated above as pelletizing or tabletizing agents and/or indicated below as encapsulating agents.

As noted above, the structural agent in accordance with this invention can be any suitable structural agent for containing and providing dimensional stability to the fuel additive and which is soluble and dispersible in fuel. The structural agents can thus include encapsulating agents. Any suitable encapsulating agent can be used. For example, any solid material which can be formed into a capsule for containing fuel additive and which is soluble and dispersible in fuel can be used. Encapsulating agents can include, for example, any of the above specified pelletizing agents. In addition, long chain alcohols having from 14 to 24 carbon atoms per molecule, more preferably from 16 to 20 carbon atoms per molecule can be employed as an encapsulating agent as well as pelletizing agents as indicated above. For example, long chain alcohols such as hexadecanol, octadecanol, and the like can be used. Capsules comprising such long chain alcohols may or may not float in fuel.

In addition suitable fused ring aromatic compounds can also be used as encapsulating agents. For example, such fused ring aromatic compounds can be such as naphthalene and the like.

The capsule can also comprise a coating agent for sealing the surface of the capsule. Any suitable pelleting or encapsulating agent listed above can be used. Preferably the coating agent is foamed wax for economy and convenience. In addition, the solid form additive can be enclosed in foil wrappers, foil and polyolefin wrappers, and the like.

Preferably the melting point and the density of the capsule are as set forth above for the pellets. The finished capsule comprising the preferred additive in accordance with this invention will float in fuel if the capsule wall material is foamed wax or a mixture of foamed wax and waxy polymeric substances and the total capsule density is less than the fuel density. It will also float if sufficient air is entrapped in the capsule. The capsule will not float in fuel in the invention comprising the preferred additives if the capsule wall material is not foamed.

In accordance with this invention a method of forming a solid form additive by encapsulation is provided. The method comprises forming a capsule from a suitable encapsulating agent, filling or partially filling the thus formed capsule with fuel additive, and sealing the thus formed capsule. Optionally, the surface of the capsule can be sealed using a coating agent. Any means for forming the capsule known in the art can be employed.

To further illustrate the instant invention, the following examples are provided.

EXAMPLE I

In a 400 milliliter (ml) beaker, 50 grams (g) of (Paraseal$^{(R)}$ available from W & F Mfg. Co., Inc., Buffalo, NY) paraffin, and 50 g of Phil-Ad CD$^{(R)}$ (carburetor detergent available from Phillips Petroleum Co., Bartlesville, OK, and of the type described in greater detail above, were heated to the melting temperature of the wax. Heat was removed and the mixture was allowed to cool while the mixture was stirred with a fritted glass dispersion tube. A gaseous phase was introduced into the heated mixture by passing a slow stream of air into the mixture through the fritted glass tube while stirring. As the mixture cooled to near the solidification temperature of the mixture, the air bubbles caused the mixture to foam and expand. When the volume no longer increased, the top of the foamed mixture was poured into pellet molds and refrigerated. The cooled pellets were then coated with unfoamed wax. The average weight of the tablets was 2.8 g, consisting of 42 weight percent Phil Ad-CD and 58 weight percent paraffin wax. The tablets floated and dissolved in gasoline in 20 minutes.

EXAMPLE II

A pellet was fabricated with an additional component, a total deposit control additive. Total deposit control additives control or reduce deposits on intake valves of the engine combustion chamber.

A foamed wax pellet containing carburetor detergent and total deposit control (TDC) additive was made following the same method in Example I. 16 g Phil-Ad CD as described in Example V below, 24 g hydrogenated polybutene TDC and 65 g paraffin wax (Sunoco #4413, m.p. 145]F, available from Sun Oil Co., St. Davids, PA) were combined in a glass beaker and heated above the melting point of the wax. Amoco H-100 polybutene, molecular weight 900, manufactured by Amoco Oil Co., was hydrogenated by standard methods over a 10% Pd/C catalyst at $H_2$ pressure 500 lb, and at temperature 160° C. to produce the hydrogenated polybutene. The beaker was removed from the heat and stirred with glass tube with fritted glass end through which air bubbles passed from a compressed air line. As the uniform mixture cooled the foam expanded. The foam was poured into 10 cc cylindrical molds and allowed to cool. The resultant pellet floated in heptane while it dissolved. Heptane is representative of gasoline for density.

EXAMPLE III

A pellet was fabricated from durene (1,2,4,5-tetramethylbenzene) and carburetor detergent. This material was not foamed nor does it float in heptane as in the case of the wax pellets. However it dissolves much more rapidly in gasoline obviating the need for a floating pellet. This product is stable at higher temperatures than wax-based pellets.

A solid pellet of durene and carburetor detergent was made as follows. 80 g durene, available from Aldrich Chem. Co., Milwaukee, Wis., Cat #T1,960-7, and 20 g Phil-Ad CD as described in Example V below, were combined in a glass beaker and heated over a water bath to form a homogeneous mixture which formed a homogeneous solid upon cooling. A 1 g piece sank and then dissolved at about 70° F. in 300 mL heptane in 17 minutes with no stirring. Heptane has less solvent power than gasoline thus the product is expected to dissolve more rapidly in gasoline.

Durene sublimes at normal room temperature, thus this pellet "bleeds" carburetor detergent if left open to the atmosphere. However, when it is kept in a sealed container minimal sublimation occurs. In a capped glass vial, a pellet was stable without "bleeding" at temperatures up to 140° F. for at least several hours.

EXAMPLE IV

In a compatibility test, a 3.7 g pellet, prepared as set forth in Example I, was dissolved in 13.58 liters (L) of unleaded gasoline. This results in a desired proportion of fuel additive to fuel (40 lb. Phil-Ad CD carburetor detergent per 1000 bbl.). In the compatibility test, a sample of the treated fuel is cooled at −20° F. for 5 hr, centrifuged for 20 min, then inspected for sediment. The sample is then heated at 110° F. for 20 hr, centrifuged for 20 min, then inspected for sediment; none was found in this sample. This indicates that the solid form additive in fuel remains soluble at extreme temperature conditions and is therefore compatible with the fuel under usual conditions.

Another sample of the fuel-additive mixture was assayed according to ASTM procedure D-2699 to determine whether the presence of the additive/wax combination caused change in the octane rating of the fuel. No significant change in octane rating was observed.

Another sample of the fuel was assayed by ASTM D 381 Existent Gum Test. The test showed 14.0 mg residue/100 mL fuel after evaporation. After washing the residue with heptane no residue remained. These results passed the test. The test results indicate that the additive does not promote gum formation.

Another sample of the fuel was assayed by ASTM D130 Copper Corrosion Test to determine the corrosivity of fuel to copper. Since fuel systems may have copper-containing parts, it is important that no unsatisfactory corrosion be induced by additives in the fuel. The test showed that the fuel-wax additive mixture gave a 1 b value, slight tarnish rating. Any value less than 2, moderate tarnish, is considered acceptable.

A Falcon Engine Test was performed using premium unleaded gasoline (hereinafter referred to as F) as a control, F plus Phil-Ad CD, F plus Phil-Ad CD and paraffin wax. The fuel was used to power a 170 CID 6-cylinder Falcon engine. The engine was run for 23 hours at 1800 rpm and 11.46 hp with continuous non-cyclic operation. About 0.5 cubic feet per minute ambient air was introduced through PCV valve below the carburetor and 3.2 cubic feet per minute of exhaust gas was recirculated unfiltered through the carburetor throttle bore. Intake air was filtered through the standard filter element. An SAE 10W-40 motor oil was used with the oil sump temperature maintained at 244°±3° F. The temperature of coolant out was maintained at 200°±3° F. and the intake air temperature was varied to control the temperature above the carburetor sleeve at 150°±2° F. The fuel flow was maintained at about 1.5 gallons per hour with the air/fuel ratio checked periodically, but not controlled; and the intake manifold vacuum recorded periodically but not controlled.

The performance of the test fuels in this test were evaluated on the basis of deposits formed on a removable aluminum sleeve in the carburetor throat. The test results are shown in Table I:

TABLE I

| Test Fuel | Deposits |
|---|---|
| F (unleaded gasoline) | 18 mg |

TABLE I-continued

| Test Fuel | Deposits |
|---|---|
| F plus 75 lb. paraffin wax per 1000 bbl. F | 15.6 mg |
| F plus 50 lb. Phil-Ad CD per 1000 bbl. F | 0.9 mg |
| F plus 50 lb. Phil-Ad CD plus 75 lbs. paraffin wax per 1000 bbl. F | 1.2 mg |

The Falcon carburetor test showed that the unleaded fuel treated with Phil-Ad CD(R) carburetor additive and paraffin wax reduced deposits by 93% as compared to untreated fuel. When unleaded fuel was treated with the same concentration of Phil-Ad CD, but in the absence of paraffin wax, deposits were reduced by 95%. These results show that the presence or absence of paraffin has virtually no effect on the detergent action of Phil-Ad CD carburetor additive in fuel.

In summary, all of these tests indicate that gasoline treated with a solid form additive in accordance with this invention, comprising Phil-Ad CD carburetor detergent and paraffin wax, is not significantly adversely affected by the presence of the wax.

EXAMPLE V

Engine tests were made with carburetor detergent (Phil-Ad CD-40 [40% carburetor detergent (of the Soya/TEBA/Acid Oil type as described in more detail above) + solvents and additives]) and paraffin wax (Sunoco #4413 paraffin wax, m.p. 145°) in gasoline (Kansas City pipeline premium gasoline) to determine their effectiveness in controlling or reducing deposits in the carburetor and intake valves.

One test was made using 170 c.i.d. 6-cylinder Falcon engine run at 2500 rpm and 32-lb load for 161 hours. This is equivalent to driving a 1979 Ford Fairmont at 55 mph constant speed.

Motor oil (TropArtic 10W-40 multigrade motor oil, Phillips Petroleum Co.) was added to the gasoline at the rate of 0.8 g/gal gasoline to accelerate deposit formation.

TABLE II

| | Falcon Engine Test | |
|---|---|---|
| Additives (PTB) | Intake Valve[1] CRC Rating | Carburetor[1] Deposits, mg |
| 80 paraffin wax + 20 carburetor detergent[2] | 4.8 | 3.7 |
| 20 carburetor detergent[2] | 4.0 | 5.8 |

[1]See Example VI for explanation of valve rating scale and carburetor deposits.
[2]Added at 50 ptb Phil-Ad CD-40 (40% carburetor detergent, 60% solvent).

This shows the combination of carburetor detergent and paraffin wax results in less deposits in both intake valves and carburetor.

Another test made with the source fuel (without added motor oil) was done on a 350 c.i.d. V-8 Chevrolet engine run for 240 hours under a variable speed. The variable program was cyclical to simulate: idle, a road speed of 55 mph, and 30 mph. The total average simulated speed was 27 mph.

TABLE III

| Additives (PTB) | Intake Valve CRC Rating |
|---|---|
| Base fuel only | 5.9 |
| 20 Phil-Ad CD | 6.2 |
| 20 Phil-Ad CD + 80 paraffin wax | 7.2 |

This shows the combination of carburetor detergent and paraffin wax results in lower intake valve deposits under variable speed conditions.

EXAMPLE VI

The combination of a total deposit control (TDC) additive, viz., hydrogenated polybutene (HPB)[4], and Phil-Ad CD in gasoline (Kansas City pipeline premium gasoline) was tested for control of deposits on the carburetor and intake valves of a 170 c.i.d., 6-cylinder Falcon engine. This test was run for 161 hours at 2500 rpm with a 32-lb load. This is about equivalent to driving a 1979 Ford Fairmont automobile at 55 mph constant speed. To accelerate deposit formation 0.8 g motor oil (TropArtic 10W-40 multigrade motor oil) was added per gal. gasoline.

TABLE IV

| Additive (ptb)[3] | Intake Valve[1] Rating | Carburetor[2] Deposit, mg |
|---|---|---|
| None | 5.4 | 29.7 |
| 10 "Phil-Ad CD-40" (PACD)[5] | 5.5 | 5.0 |
| 10 PACD + 15 HPB | 5.7 | 23.4 |
| 10 PACD + 30 HPB | 6.8 | 16.3 |
| 10 PACD + 50 HPB | 7.0 | 13.8 |

[1]CRC intake valve rating average of 6 valves, scale of 0–10 where 10 = perfectly clean.
[2]mg Deposit in aluminum sleeve in carburetor after washing with heptane.
[3]ptb pounds of additive per 1000 bbl gasoline.
[4]Amoco H100 polybutene, hydrogenated as in Example II.
[5]Phil-Ad CD-40 commercially formulated carburetor detergent, Phillips Petroleum Co.

This shows that the combination of Phil-AD CD-40 and HPB reduces both intake valve deposits and carburetor deposits compared to deposits formed without these additives.

EXAMPLE VII

In these runs, natural waxes, paraffins, microcrystalline waxes, long chain alcohols, and various polymeric substances were tested for solubility in fuel. The minimum solubility chosen was 0.1 g/100 cc heptane. The amount was selected to be on the high side of concentration of the waxes or waxy polymeric substances expected to be in fuel tanks to assure that no precipitating out of the structural agent would occur if an excess were added. Heptane was chosen as being comparable to a low grade of fuel. Better grades of fuel are expected to better solubilize the structural agents. Results of the solubility test are given in Table V.

TABLE V

| Material | Soluble in heptane | Available from |
|---|---|---|
| U.S.P. Bleached Beeswax | No. | Frank Ross, Inc. Jersey City, NJ |
| Refined Yellow Beeswax | No | Frank Ross, Inc. Jersey City, NJ |
| Refined Candelilla Wax | No | Frank Ross, Inc. Jersey City, NJ |
| Montan Wax | No | Frank Ross, Inc. Jersey City, NJ |
| Refined Ouricury Wax | No | Frank Ross, Inc. Jersey City, NJ |
| Ozokerite Wax | No | Frank Ross, Inc. Jersey City, NJ |
| Palm Wax | No | Frank Ross, Inc. Jersey City, NJ |
| Shellac Wax | No | Frank Ross, Inc. Jersey City, NJ |
| Refined Paraffin Wax 130/135 | Yes | Frank Ross, Inc. Jersey City, NJ |
| Refined Paraffin Wax 140/145 | Yes | Frank Ross, Inc. Jersey City, NJ |
| Paraseal ® paraffin wax | Yes | W & F Mfg. Co., Inc. Buffalo, NY 14240 |
| Be Square ® (Microcrystalline 190° F. and 196° F. mp) | No | Petrolite Corp. Bareco Div. - Tulsa, Okla. |
| Starwax ® 100 (Microcrystalline 187° F. mp) | No | Petrolite Corp. Bareco Div. - Tulsa, Okla. |
| Petrolite ® (Microcrystalline 196° F. and 199° F. mp) | No | Petrolite Corp. Bareco Div. - Tulsa, Okla. |
| Be Square ® 175 (Plastic Wax 182° F. mp) | No | Petrolite Corp. Bareco Div. - Tulsa, Okla. |
| Victory ® (Plastic Wax 175° F. mp) | No | Petrolite Corp. Bareco Div. - Tulsa, Okla. |
| Vybar ® 103, 162° F. mp polymer | No | Petrolite Corp. Bareco Div. - Tulsa, Okla. |
| Vybar ® 260, 124° F. mp polymer | Yes | Petrolite Corp. Bareco Div. - Tulsa, Okla. |
| Hexadecanol | Yes | — |
| Octadecanol | Yes | — |
| Naphthalene | Yes | — |
| Polymer C | No | Crowley Hydrocarbon Chem Co., 271 Madison Ave., New York, N.Y. |
| Polytac R-500 | No | Crowley Hydrocarbon Chem Co., 271 Madison Ave., New York, N.Y. |
| Polytac R-1000 | No | Crowley Hydrocarbon Chem Co., 271 Madison Ave., New York, N.Y. |
| Polytac R-2000 | No | Crowley Hydrocarbon Chem Co., 271 Madison Ave., New York, N.Y. |
| Camphor | Yes | — |
| Stearic Acid | Yes | — |
| Synthetic Lube Residue | No | — |
| Atactic Polypropylene | No | — |
| K-Resin ® | No | Phillips Petroleum Co. Bartlesville, OK |
| Sunoco #4413 | Yes | Sun Oil Co. St. David's, PA |
| Durene | Yes | Aldrich Chem. Co. Milwaukee, Wis. |

These results indicate that naturally occurring waxes such as beeswax, candelilla wax, and the like are generally nonsoluble in heptane. Paraffin waxes, such as the Refined Paraffin Waxes and Paraseal paraffin wax, comprising generally unbranched n-paraffinic hydrocarbons, were generally soluble. Microcrystalline waxes, such as Be Square and Starwax and the like, and plastic waxes, such as Victory and the like, were generally nonsoluble. Microcrystalline waxes and plastic waxes differ from paraffin waxes which generally contain 90% or more unbranched n-paraffinic hydrocarbons by containing a lower concentration of n-paraffinic hydrocarbons and a higher proportion of branched paraffinic and naphthenic hydrocarbons. Polymeric substances were generally nonsoluble in heptane with the exception of such compounds as Vybar 260, an ethylene derived hydrocarbon polymer. Vybar 260, an ethylene derived hydrocarbon polymer, is however suitable for use as structural agent.

The soluble waxes and waxy polymeric substances shown in Table V were then tested for ability to foam and sufficiently entrap gas upon solidification. If the foamed solid floated in pentane, it was considered to pass the test. Pentane was chosen because pentane has a lower density than most fuel components. Hence, if a structural agent floated in pentane, it can float in most any fuel. The results of the density test are shown in Table VI.

TABLE VI

| Material | Foams and Floats in pentane |
|---|---|
| Paraseal ® paraffin | Yes |
| Vybar ® 260 | No |
| Hexadecanol | No |
| Octadecanol | No |
| 95% paraffin 5% Vybar 260 | Yes |

Table VI showed that waxes such as Refined Paraffin Wax 130/135, Refined Paraffin Wax 140/145, and Paraseal paraffin wax are soluble in heptane. Table V also showed that waxy polymeric substances such as Vybar 260, 124° F. melting point polymer can be soluble in heptane. Table V also showed that long chain alcohols are soluble in heptane.

Table VI shows that of the soluble waxes and long chain alcohols and waxy polymeric substances, some were unsuitable alone for foaming. In the case of long chain alcohols, however, adequate foaming was observed when a mixture of long chain alcohol and carburetor detergents of the type described in more detail above were employed.

Table V also shows that some of the materials were unsuitable for the practice of the invention according to its preferred embodiment. Some materials were found unsuitable because of low solubility (less that 0.1 g/100 cc heptane at 20° C.). These unsuitable materials include petroleum microcrystalline waxes consisting of n-paraffinic, branched paraffinic, and naphthenic hydrocarbons in the molecular weight range of 490 to 900. These microcrystalline waxes include such as Be Square, Starwax 100, Petrolite, Victory. The unsuitable materials also include amorphous polypropylenes such as the Polymer C, and Polytac series. Other unsuitable materials as shown in Table V and discussed above include certain naturally occurring waxes as beeswax, ouricury, ozokerite, and candelilla wax.

Table V and Table VI together show that some materials such as long chain alcohols are soluble in heptane but do not foam alone. Such materials can be used for encapsulating agents. In addition, as noted above, the long chain alcohols in the presence of an additive can foam adequately to be used as pelletizing agents according to the invention.

EXAMPLE VIII

A preferred form of the coated solid form additive is illustrated in this example.

About 150 g of 2:1 wt/wt mixture of Phil-Ad CD/Paraseal paraffin wax in a 400 mL beaker was melted on a hot plate. Then the heat was removed and air was introduced to the liquid through a fritted glass dispersion tube. As the liquid cooled while stirring with the dispersion tube the mixture foamed greatly increasing in volume. The top of the foamed mixture was poured into oil-coated crucible and allowed to cool under refrigeration to form a solid pellet weighing 13.9 g.

This pellet was then dipped into similarly foamed wax to form a sealing coat of foamed wax. The cooled pellet was allowed to cool to solidify the coating. Final weight of the pellet was 18.0 g.

EXAMPLE IX

A preferred form of the uncoated solid form additive is illustrated in this example.

A foamed pellet comprising 80% paraffin wax (Sunoco #4413, m.p. 145° F.) and 20% Soya/TEPA/Acid Oil carburetor detergent of the type herein described was formed using generally the method of Example VIII above except that the pellet was not coated. The foamed uncoated pellet weighed 13.95 g and floated in heptane.

The invention has been illustrated by preferred embodiment and examples as required. However the invention is not limited thereto but to the subject matter claimed.

What is claimed is:

1. A method of forming solid form fuel additives comprising:

heating together a structural agent effective, upon cooling, to provide dimensional stability to the solid form fuel addititive, the structural agent being soluble and dispersible in gasoline, and a normally liquid fuel additive to at least the melting point temperature of the structural agent;

allowing the thus-formed mixture of additive and structural agent to cool;

stirring the thus formed mixture of additive and structural agent;

foaming the mixture by dispersing a gaseous phase as fine bubbles in the mixture, said mixture being close to and above a solidification temperature of the mixture; and forming the thus formed foam into solid pellets soluble and dispersible in gasoline.

2. A method as in claim 1 wherein:

the gaseous phase is selected from the group consisting of $N_2$, $CO_2$, air, and mixtures thereof.

3. A method as in claim 1 comprising:

molding the foamed mixture into pellets; allowing the molded pellets to cool to form said solid pellets soluble and dispersible in gasoline.

4. A method as in claim 2 comprising:

extruding the foamed mixture and cooling the extruded foamed mixture to form a solid extrudate.

5. A method as in claim 3 wherein:

the thus formed solid form additive is sealed with a coating agent.

6. A method as in claim 5 wherein:

the structural agent is selected from the group consisting of refined paraffin wax, slack wax, scale wax, waxy polymeric substances, and mixtures thereof.

7. A method as in claim 6 wherein:

the normally-liquid fuel additive is prepared in a process comprising reacting one or more vegetable oils selected from the group consisting of triglycerides of long chain monocarboxylic acids of the formula

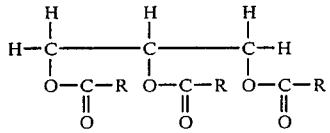

where R is an aliphatic radical of about 10 to about 25 carbon atoms with a multiamine to produce a product mixture.

8. A method as in claim 7 wherein:

the multiamines have the general formula $H_2N(CH_2CH_2NH)_xH$ where x is an integer between 2 and 10 inclusive.

9. A method as in claim 8 wherein:

the vegetable oils are selected from the group consisting of cotton seed oil, peanut oil, rapeseed oil, soybean oil, corn oil, coconut oil, and mixtures of any two or more thereof.

10. A method as in claim 9 wherein:

the multiamine is polyethyleneimine.

11. A method as in claim 7 wherein:

the coating agent is selected from the group consisting of refined paraffin waxes consisting primarily of straight chain hydrocarbons with a relatively small proportion of branched material, slack wax, scale wax, waxy polymeric substances which are soluble and dispersible in fuel, and long chain alcohols which are soluble and dispersible in fuel.

12. A method as in claim 11 wherein:

the coating agent is foamed refined paraffin waxes.

13. A method of preparing a solid form gasoline additive comprising:

encapsulating a normally liquid fuel additive selected from carburetor detergent additives, antiknock additives, deposit control additives, and mixtures thereof, suitable for use in fuel comprising gasoline for internal combustion engines, with a structural agent effective for providing dimensional stability to the solid form gasoline additive, the structural agent being soluble and dispersible in the fuel; and sealing the capsule.

14. A method as in claim 13 further comprising:

coating the thus sealed capsule with a coating agent to seal the surface thereof.

15. A method as in claim 14 wherein:

the structural agent is selected from the group consisting of refined paraffin wax, slack wax, scale wax, waxy polymeric substances, and mixtures thereof.

16. A method as in claim 15 wherein:

the additive is prepared by reacting one or more vegetable oils selected from the group consisting of triglycerides of long chain monocarboxylic acids of the formula

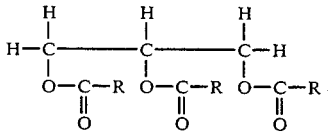

where R is an alphatic radical of about 10 to about 25 carbon atoms with a multiamine to produce a product mixture.

17. A method as in claim 16 wherein:

the multiamines have the general formula $H_2N(CH_2CH_2NH)_xH$ where x is an integer between 2 and 10 inclusive.

18. A method as in claim 17 wherein:

the vegetable oils are selected from the group consisting of cotton seed oil, peanut oil, rapeseed oil, soybean oil, corn oil, and coconut oil.

19. A method as in claim 18 wherein:

the multiamine is polyethyleneimine.

20. A method as in claim 9 wherein:

the product mixture is reacted with a sulfonic acid.

21. A method as in claim 19 wherein:

the sulfonic acid is selected from the group consisting of sulfonic acids having the general formula $R'SO_3H$ where R' is alkyl, aryl, alkaryl, aralky, cycloalkyl with 6 to 100 carbon atoms.

22. A method as in claim 19 wherein:

the sulfonic acid is selected from the group consisting of dodecylbenzenesulfonic acid, octadecylsulfonic acid, dodecylsulfonic acid, and sulfonic acid oil.

23. A method as in claim 19 wherein:

the sulfonic acid is obtained by treating lubricating stock with sulfur trioxide.

* * * * *